United States Patent [19]

Weaver

[11] Patent Number: 5,064,384

[45] Date of Patent: Nov. 12, 1991

[54] JUMPER ASSEMBLY FOR MULTIPLE BREAKER APPLICATION

[75] Inventor: William J. Weaver, Lincoln, Nebr.

[73] Assignee: Square D Company, Palatine, Ill.

[21] Appl. No.: 622,039

[22] Filed: Dec. 4, 1990

[51] Int. Cl.[5] ..... H01R 31/08; H01R 9/22

[52] U.S. Cl. ..... 439/511; 439/709

[58] Field of Search ..... 439/511, 514, 515, 709, 439/711, 721

[56] References Cited

U.S. PATENT DOCUMENTS

| | | | |
|---|---|---|---|
| 3,909,097 | 9/1975 | Roth et al. | 439/511 |
| 3,941,443 | 3/1976 | Reimer | 439/709 |
| 4,785,378 | 11/1988 | Hinckley | 361/363 |

*Primary Examiner*—Paula A. Bradley

*Attorney, Agent, or Firm*—Larry I. Golden; Jose W. Jimenez

[57] ABSTRACT

A wire-jumper assembly including an electrically insulating base having an insulating layer. A first conductor plate is positioned below said insulating layer, and a second conductor plate is positioned on top of said insulating layer. The conductor plates each include extension contacts directed outwardly from the base. The wire-jumper assembly also includes a pair of terminal lugs connected to said first conductor plate and said second conductor plate, respectively. A lead wire is secured to each of the terminal lugs. An additional cover can be installed on top of the wire-jumper assembly to provide safety from accidental contact.

15 Claims, 9 Drawing Sheets

JUMPER ASSEMBLY FOR MULTIPLE BREAKER APPLICATION

FIELD OF THE INVENTION

The present invention relates generally to circuit breakers. This invention particularly relates to jumper assemblies for interconnecting multiple individually mounted circuit breakers for reducing the space and time required to install a terminal lug and connect wires from the terminal lug to each circuit breaker.

BACKGROUND OF THE INVENTION

Circuit breakers are commonly wired from incoming main lead wires as illustrated in FIG. 1. Two incoming main lead wires 1 and 2 are each connected to four terminal lugs 3 and 4, respectively, of the wire-jumper assembly 10. A connecting wire 5 extends from each terminal lug 6 to receptors 7 of the circuit breaker assembly 8 so as to wire three circuit breakers from the incoming main lead wires 1 and 2. Wires (not shown) exiting the opposing side of the circuit breaker assembly 8 lead to the loads. Unfortunately, this system of wiring multiple circuit breakers requires a burdensome amount of space and labor to install the terminal lugs and requires excessive wiring to connect each pole of the circuit breakers.

SUMMARY OF THE INVENTION

It is a general object of the present invention to provide an assembly which overcomes the aforementioned deficiencies of the prior art.

It is a more specific object of the present invention to provide an improved wire-jumper assembly for interconnecting multiple individually mounted circuit breakers which eliminates the need for the wires that connect a terminal lug to a pole of an individually mounted circuit breaker.

It is another object of this invention to provide an improved jumper assembly for interconnecting multiple individually mounted circuit breakers which eliminates the need for multiple terminal lugs in order to connect a plurality of individually mounted circuit breakers to two main lead wires, which minimizes the space that is required for housing the wire-jumper assembly and the circuit breaker assembly, and which is less costly than the circuit breaker assemblies of the prior art.

In accordance with the present invention, the foregoing objectives are realized by providing a wire-jumper assembly including an electrically insulating base having an insulating layer. A first conductor plate is positioned below the insulating layer, and a second conductor plate is positioned on top of the insulating layer. The conductor plates each include extension contacts directed outwardly from the base. The wire-jumper assembly also includes a pair of terminal lugs respectively connected to the first conductor plate and the second conductor plate, respectively. A lead wire is secured to each of the terminal lugs. An additional cover can be installed on top of the wire-jumper assembly to provide safety from accidental electrical contact.

BRIEF DESCRIPTION OF THE DRAWINGS

Other objects and advantages of the invention will be apparent from the following detailed description and the accompanying drawings in which.

Figure 1:
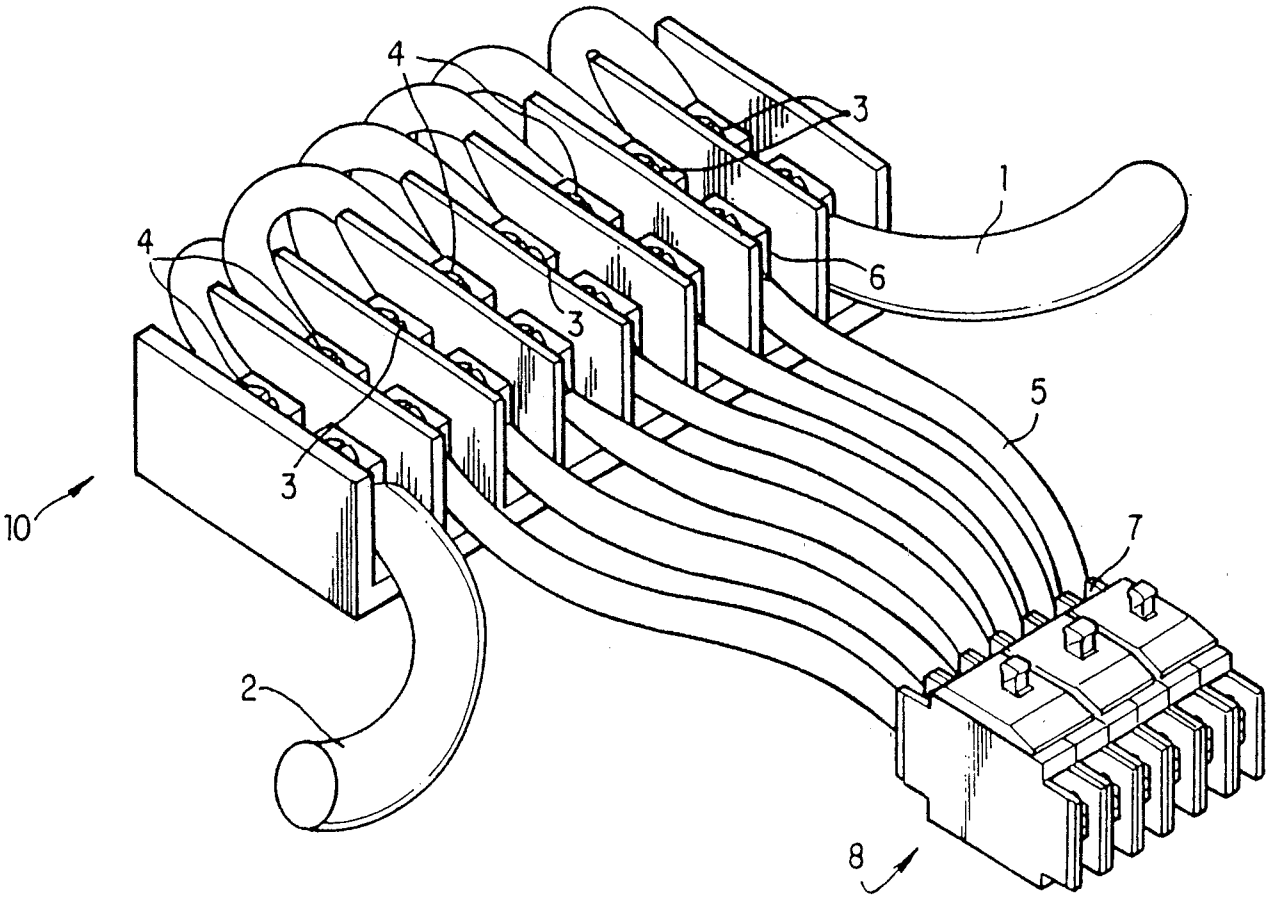
FIG. 1 PRIOR ART
FIG. 1 is a perspective view of a conventional wire-jumper assembly.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF THE PREFERRED EMBODIMENT

Figure 2:
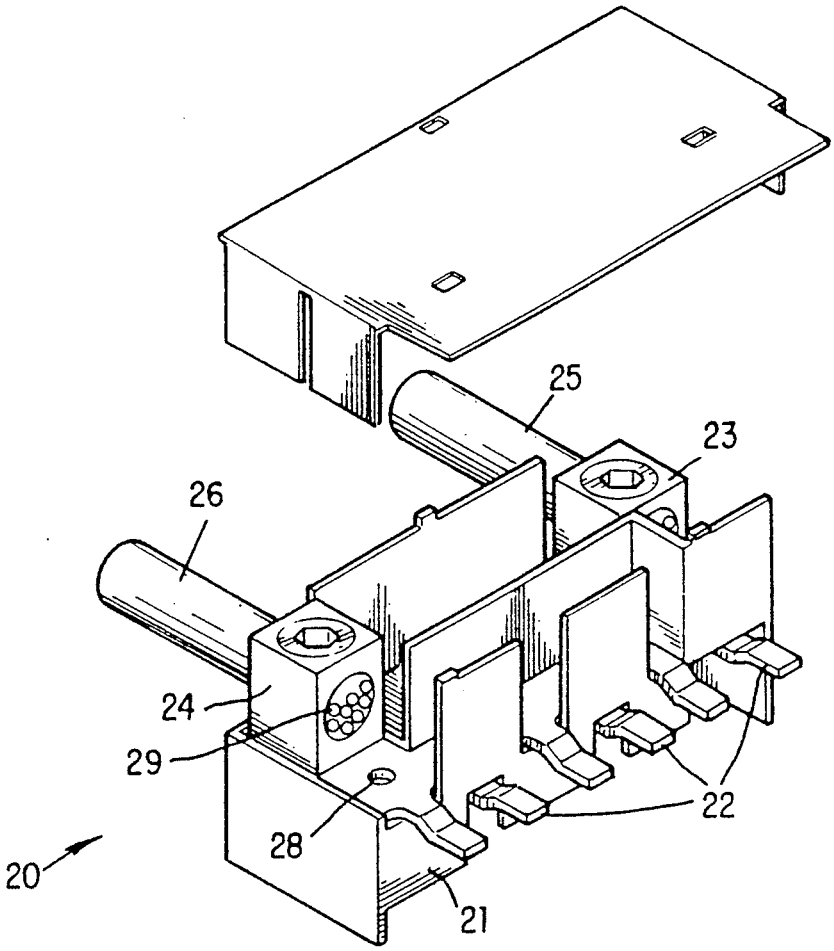
FIG. 2 is a perspective view of the wire-jumper assembly of the present invention with lead wires entering from the end of the assembly opposite the extension contacts.
Figure 3:
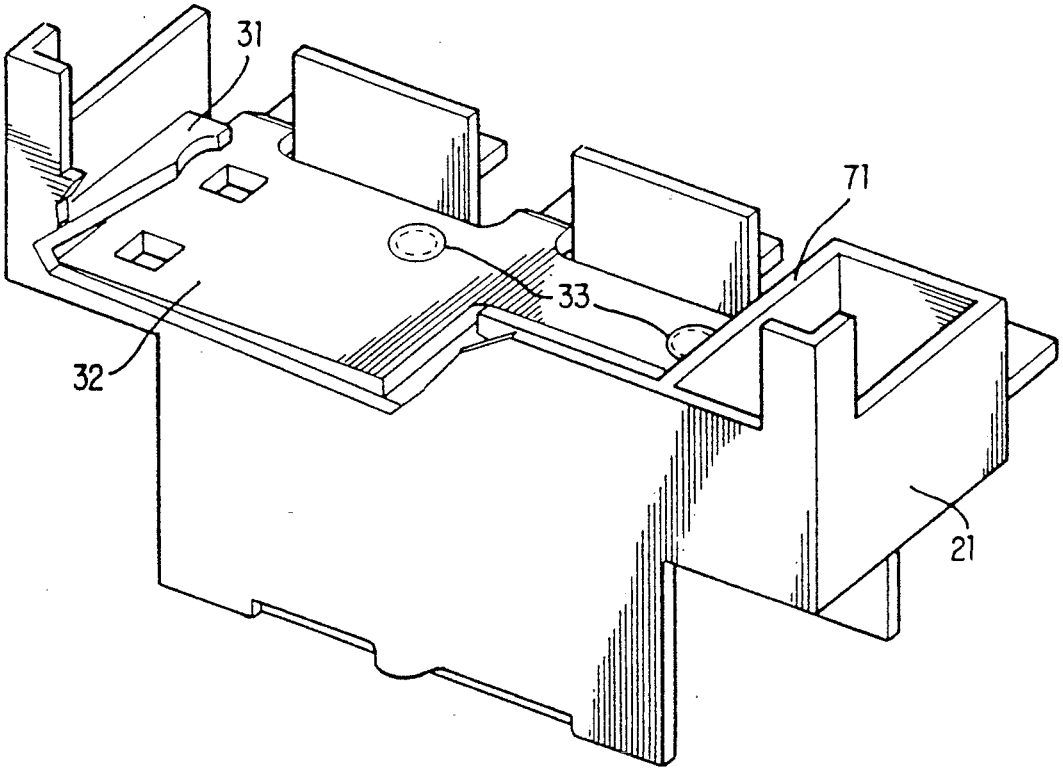
FIG. 3 is a fragmentary perspective view of the attachment of the first conductor plate to the insulating layer.
Figure 4:
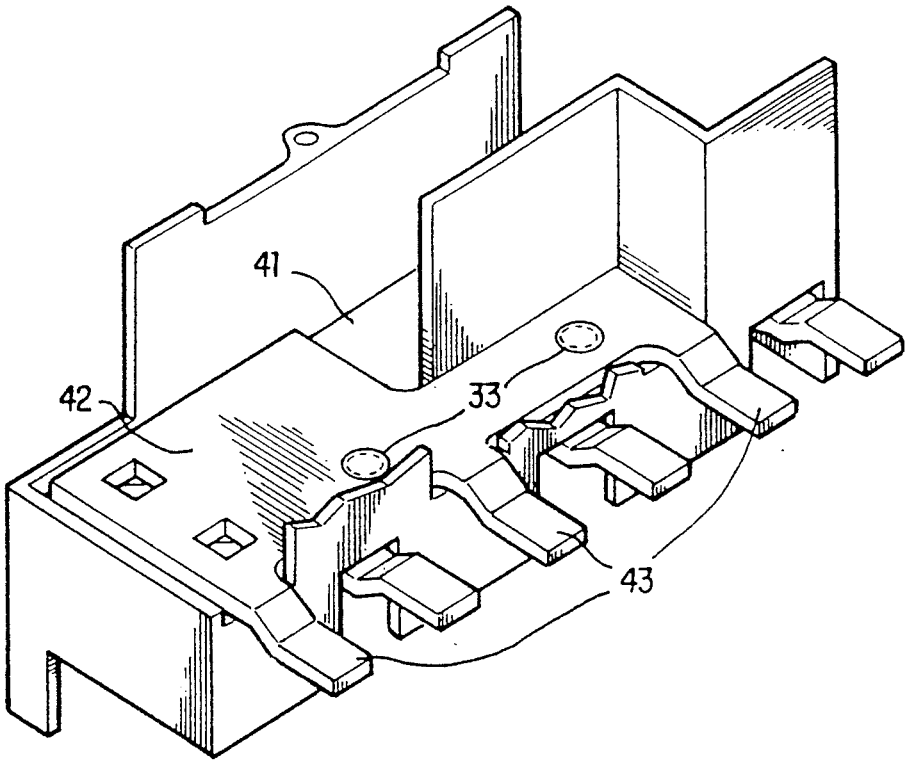
FIG. 4 is a fragmentary perspective view of the attachment of the second conductor plate to the insulator.

Turning now to the drawings and referring specifically to FIGS. 2–4, a wire-jumper assembly 20 generally comprises an electrically insulating base 21. A first conductor plate 32 (FIG. 3) having a plurality of extension contacts 22 is positioned on top of a mounting area 31 and below an insulating layer 41 (FIG. 4). The first conductor plate 32 is positioned below the insulating layer 41 in order to insulate the first conductor plate 32 from the second conductor plate 42 (FIG. 4). The second conductor plate 42 having extension contacts 43 is positioned on top of the insulating layer 41.

As can be seen in the fragmentary perspective views of FIG. 3 and FIG. 4, the first conductor plate 32 and the second conductor plate 42 include two holes through which posts 33 extend. Posts 33 are an integral part of the insulating layer 41 of the electrically insulating base 21. By heating the posts 33, the first conductor plate 32 and the second conductor plate 42 are connected to the insulating layer 41 because the posts 33 melt over the second conductor plate 42. Alternatively, a spring clip can be installed over each post to secure the conductor plates to the insulating layer.

As can be seen in the perspective view of FIG. 2, an incoming lead wire 25 is mounted within a first terminal lug 23 which is connected to the first conductor plate 32 to electrically connect the incoming lead wire 25 to the first conductor plate 32. In order to electrically connect an incoming lead wire 26 to the second conductor plate 42, the incoming lead wire 26 is mounted within a second terminal lug 24 which is connected to the second conductor plate 42. To attach the incoming lead wires 25 and 26 to the respective terminal lugs 23 and 24, the incoming lead wires enter a hole (not shown) opposite the hole 29 of the terminal lugs and extend through the hole until the wires are flush with the outer surface of the terminal lug. In order to connect the terminal lugs 23 and 24 to the respective first and second conductor plates, a screw (not shown) is passed through one of the two holes 28 which are in the first and second conductor plates. The screw is threaded into the terminal lugs 23 and 24 so as to firmly attach the terminal lugs 23 and 24 to the first conductor plate 32 and the second conductor plate 42 respectively.

Figure 6:
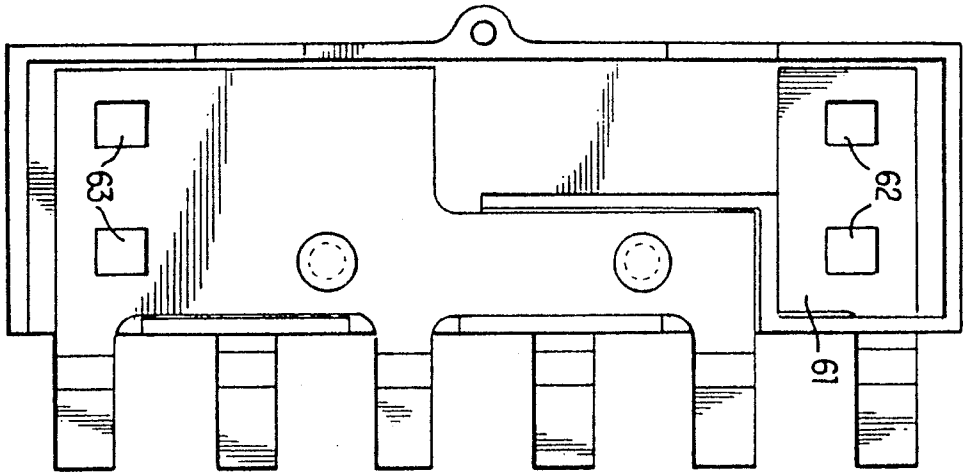
FIG. 6 is a top view of the wire-jumper assembly with its cover removed.

The terminal lugs 23 and 24 are connected to the first conductor plate 32 and the second conductor plate 42 respectively through either of the respective holes 62 or 63 as shown in FIG. 6. The position of the terminal lugs 23 and 24 are determined by the locations of the incoming lead wires as will be described below.

As can be seen most clearly in FIG. 6, the insulating layer 41 (FIG. 4) does not extend over the mounting area 61 at which the terminal lug 23 is connected to the first conductor plate 32 so that the electrical connection is made between the terminal lug 23 and the first conductor plate 32.

Figure 8:
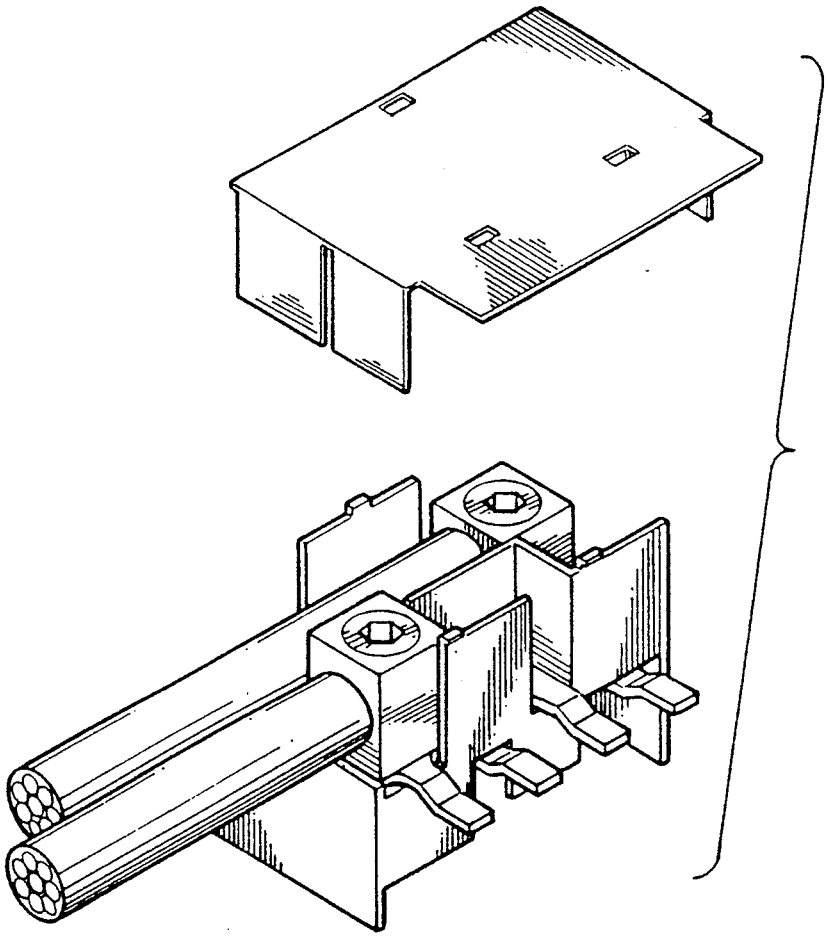
FIG. 8 is a perspective view of the wire-jumper assembly with the lead wires entering from the left side of the assembly.
Figure 9:
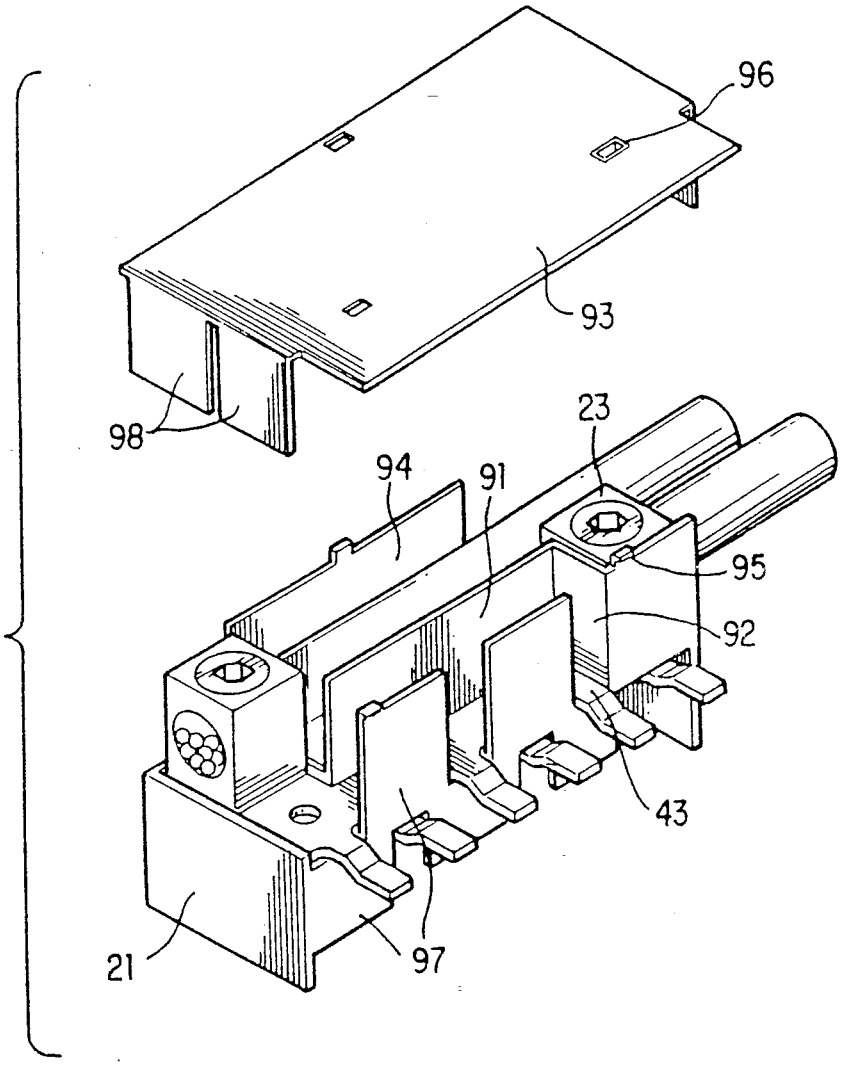
FIG. 9 is a perspective view of the wire-jumper assembly including a cover, wherein the lead wires enter the assembly from the right side.

The electrically insulating base 21 may be formed so that the incoming lead wires 25 and 26 attach to the respective terminal lugs 23 and 24 at either side of the insulating base 21 which is adjacent to the extension contacts 22 and 43. Thus, in the illustrative embodiment shown in FIG. 8, the incoming lead wires are connected to the left side of the terminal lugs of a jumper assembly for 2 −2 pole circuit breakers. FIG. 9 illustrates a right side attachment of the incoming lead wires to the terminal lugs of a jumper assembly for 3 −2 pole circuit breakers.

In accordance with a further feature of the invention and as illustrated in FIG. 9, the electrically insulating base 21 includes a guide wall 91 as an integral part of the molded base in order to guide the incoming lead wires 25 and 26 to their respective positions. Guide wall 91 includes a portion 92 of the wall which physically and electrically separates the second conductor plate 42 from the terminal lug 23. Guide wall 91 additionally serves to attach the cover 93 to the wire-jumper assembly 20 when the tab 95 of the guide wall 91 interlocks with the slot 96 of the cover 93. The sections 98 on the sides of the cover 93 can be bent or broken off to allow the lead wires 25 and 26 to enter the jumper assembly as described above.

The posterior wall 94 of the electrically insulating base 21 acts as a guide wall for an incoming lead wire, protects the user of the wire-jumper assembly upon occurrence of accidental contact, and serves to attach the cover as described above.

The anterior wall 97 of the electrically insulating base 21 provides a gas shield to prevent cross-phasing of gases to the opposite phase conductor plate. Moreover, the anterior wall 97 serves to attach the cover as above described, and protects the user from accidental contact.

Figure 7:
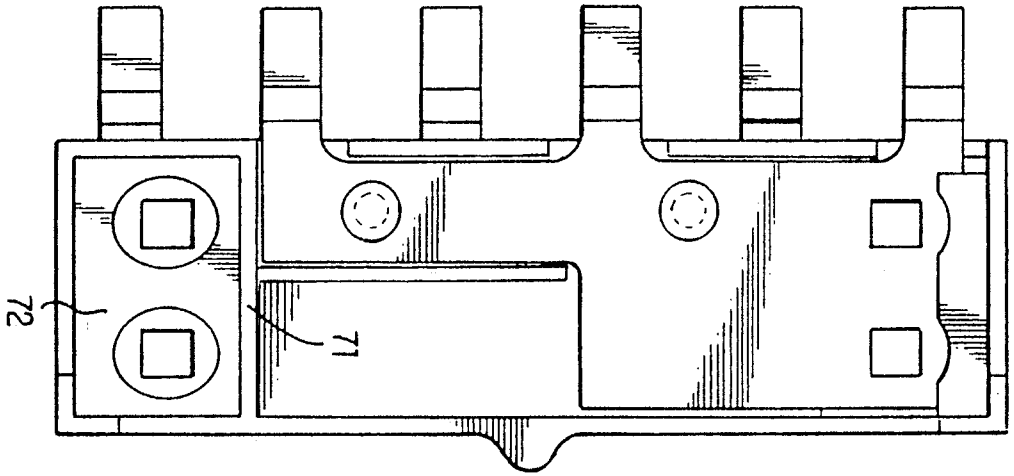
FIG. 7 is a bottom view of the wire-jumper assembly.

As shown in FIG. 3 and FIG. 7, the mounting area 72 for the terminal lug 24 is separated from the first conductor plate 32 by a partition 71 which is an integral part of the electrically insulating base 21.

Figure 5:
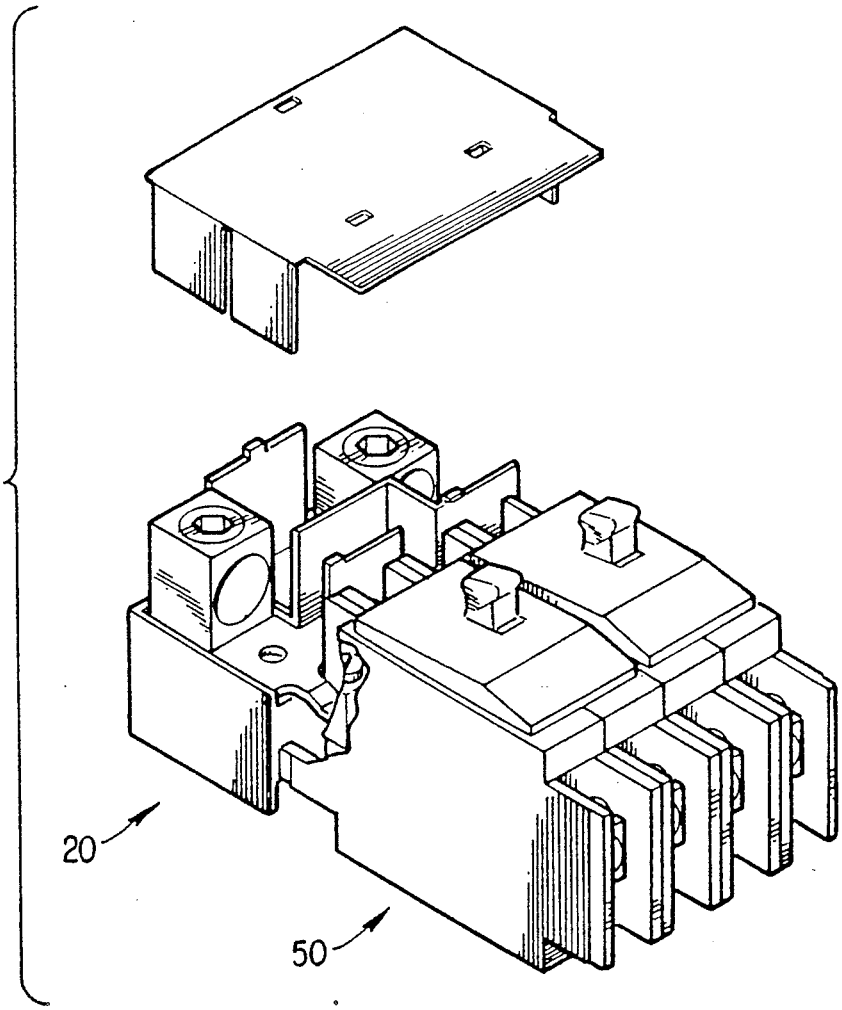
FIG. 5 is a perspective view of a wire-jumper assembly of the present invention with its cover removed, interconnected with a circuit breaker assembly.

As illustrated in the perspective view of FIG. 5, the extension contacts 22 and 43 of the wire-jumper assembly 20 interconnect with female receptors of the circuit breaker assembly 50 to electrically connect the terminal lugs 23 and 24 to the circuit breaker assembly 50. Through interconnecting the extension contacts with the circuit breaker assembly, the need for a plurality of wires to connect the terminal lugs to the circuit breakers is eliminated.

As can be seen from the foregoing detailed description, the present invention provides a wire-jumper assembly which eliminates the need for multiple terminal lugs and excessive wiring to connect the incoming lead wires to the circuit breakers.

The foregoing description is not limited to the specific embodiments herein described. The wire-jumper assembly may be manufactured to interconnect with a circuit breaker unit mounting base having a plurality of individually mounted circuit breakers. The conductor plates and the insulating layer may contain a plurality of holes for connecting the terminal lug to the conductor plate. Moreover, the insulating layer may include a plurality of posts for mounting the conductor plates. Alternatively, the conductor plates may be attached to the insulating layer by means other than melting, such as by installing spring clips over each post. The guide wall may vary in length such that it extends partially between the opposing ends of the conductor plates. The cover of the wire-jumper assembly may be attached to the electrically insulating base by screwing the cover into threaded receptors of the base.

What is claimed is:

1. A wire-jumper assembly which connects a plurality of circuit breakers, the assembly comprising:

an electrically insulating base;

insulating means coupled to said base;

a first conductor plate positioned below said insulating means and including a first set of extension contacts directed outwardly from the base;

a second conductor plate positioned over said insulating means and including a second set of extension contacts directed outwardly from the base adjacent the first set of extension contacts, wherein said insulating means electrically insulates said first conductor plate from said second conductor plate; and a plurality of terminal lugs, connected to said first conductor plate and said second conductor plate, respectively.

2. The wire-jumper assembly of claim 1 wherein each extension contact of the first set of extension contacts is adjacent to an extension contact of the second set of extension contacts to establish an alternating arrangement.

3. The wire-jumper assembly of claim 1 wherein the second set of extension contacts is offset with respect to said second conductor plate.

4. The wire-jumper assembly of claim 1 wherein the first set of extension contacts and the second set of extension contacts are substantially coplanar.

5. The wire-jumper assembly of claim 1 wherein said insulating means has four corners, and said first terminal lug and said second terminal lug are connected at opposite corners of said insulating means.

6. The wire-jumper assembly of claim 1 wherein said insulating means has four corners, and said first terminal lug and said second terminal lug are connected at adjacent corners of said insulating means that are opposite the extension contacts.

7. The wire-jumper assembly of claim 1 wherein the first set of extension contacts is offset with respect to said first conductor plate.

8. The wire-jumper assembly of claim 7 wherein the second set of extension contacts is offset with respect to said second conductor plate.

9. A wire-jumper assembly which connects to a circuit breaker assembly having female receptor means for receiving extension contacts and individually mounted circuit breakers, the assembly comprising:

an electrically insulating base having insulating means;

a first conductor plate positioned below said insulating means and including a first set of extension contacts directed outwardly from the base;

a second conductor plate positioned over said insulating means and including a second set of extension contacts directed outwardly from the base adjacent the first set of extension contacts, wherein said insulating means electrically insulates said first conductor plate from said second conductor plate; and a plurality of terminal lugs connected to said first conductor plate and said second conductor plate, respectively.

10. The wire-jumper assembly of claim 9 wherein the the extension contacts of the first and second sets of extension contacts establish an alternating arrangement.

11. The wire-jumper assembly of claim 9 wherein the first set of extension contacts and the second set of extension contacts are offset from each other.

12. The wire-jumper assembly of claim 9 wherein the assembly includes a cover for preventing accidental contact.

13. The wire-jumper assembly of claim 9 including attachment means for attaching said first conductor plate and said second conductor plate to said insulating means.

14. The wire-jumper assembly of claim 13 wherein said first and second conductor plates include a plurality of holes;

wherein said insulating means includes a plurality of posts integrally molded thereto wherein said plurality of holes of said first conductor plate and said second conductor plate are fitted onto said plurality of posts; and said posts are melted to attach said conductor plates to said insulating means.

15. The wire-jumper assembly of claim 13 wherein said first and second conductor plates include a plurality of holes;

wherein said insulating means includes a plurality of posts integrally molded thereto wherein said plurality of holes of said first conductor plate and said second conductor plate are fitted onto said plurality of posts; and spring clips are placed over said posts to attach said conductor plates to said insulating means.

* * * * *